US009685146B2

(12) United States Patent
Shigenaga et al.

(10) Patent No.: US 9,685,146 B2
(45) Date of Patent: Jun. 20, 2017

(54) DRUM BEATER AND DRUM FOOT PEDAL APPARATUS

(71) Applicant: YAMAHA CORPORATION, Hamamatsu-shi (JP)

(72) Inventors: Fumihiro Shigenaga, Hamamatsu (JP); Shinsuke Irisa, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/278,781

(22) Filed: Sep. 28, 2016

(65) Prior Publication Data

US 2017/0092242 A1 Mar. 30, 2017

(30) Foreign Application Priority Data

Sep. 30, 2015 (JP) ..... 2015-194502

(51) Int. Cl.
*G10D 13/00* (2006.01)
*G10D 13/02* (2006.01)

(52) U.S. Cl.
CPC ..... *G10D 13/006* (2013.01); *G10D 13/00* (2013.01); *G10D 13/003* (2013.01); *G10D 13/02* (2013.01)

(58) Field of Classification Search
CPC ..... G10D 13/006; G10D 13/00; G10D 13/02; G10D 13/003
USPC ..... 84/422.1
See application file for complete search history.

(56) References Cited

U.S. PATENT DOCUMENTS 1,343,164 A * 6/1920 Smith ..... G10D 13/006 84/422.1
2,586,163 A * 2/1952 Heiderich ..... G10D 13/003 84/422.4
4,200,025 A * 4/1980 Currier ..... G10H 3/14 84/422.1

(Continued)

FOREIGN PATENT DOCUMENTS

JP H0895557 A 4/1996
JP 2806301 B2 9/1998

(Continued)

OTHER PUBLICATIONS

Copending U.S. Appl. No. 15/278,704, filed on Sep. 28, 2016.

(Continued)

*Primary Examiner* — David Warren
*Assistant Examiner* — Christina Schreiber
(74) *Attorney, Agent, or Firm* — Rossi, Kimms & McDowell LLP

(57) ABSTRACT

Disclosed are a drum beater and a drum foot pedal apparatus which are simple in construction with reduced numbers of component parts and yet allow weight adjustment of the beater to be performed promptly and reliably through a mere manual operation without using any tool, and which include: a beater head for striking a drum; a beater rod having the beater head mounted thereon; a retention member mounted on the beater rod, through a mere manual operation without using any tool, in such a manner that it is axially displaceable relative to the beater rod; a spring normally biasing the retention member toward the beater rod; and a weight member held sandwiched between the retention member and the beater head by the biasing force of the spring.

9 Claims, 9 Drawing Sheets

(56) References Cited

U.S. PATENT DOCUMENTS 4,691,612 A * 9/1987 Smith ..... G10D 13/006 84/422.1
5,427,010 A * 6/1995 Hoshino ..... G10D 13/003 84/422.1
5,565,637 A * 10/1996 Shigenaga ..... G10D 13/006 84/422.1
5,798,472 A * 8/1998 Shigenaga ..... G10D 13/006 84/413
5,817,962 A * 10/1998 Behrenfeld ..... G10D 13/003 84/422.1
5,932,824 A * 8/1999 Liao ..... G10D 13/003 84/422.1
5,936,177 A * 8/1999 Shigenaga ..... G10D 13/006 84/422.1
5,945,616 A * 8/1999 Hoshino ..... G10D 13/065 84/422.3
5,998,719 A * 12/1999 Chuang ..... G10D 13/003 84/422.4
6,028,259 A * 2/2000 Lombardi ..... G10D 13/006 84/422.1
6,028,260 A * 2/2000 LaLonde ..... G10D 13/003 84/422.4
6,894,210 B1 5/2005 Lombardi
7,122,730 B2 * 10/2006 Takegawa ..... G10D 13/006 84/422.1
7,626,108 B1 * 12/2009 Takegawa ..... G10D 13/003 84/422.1
8,633,367 B2 * 1/2014 Steinhauser ..... G10D 13/006 84/422.2
8,859,871 B2 * 10/2014 Liao ..... G10D 13/02 84/422.4
9,236,038 B1 1/2016 Hirasawa
2002/0152873 A1 10/2002 Shigenaga

FOREIGN PATENT DOCUMENTS

JP 3584898 B2 11/2004
JP 2016095379 A 5/2016

OTHER PUBLICATIONS

Office Action issued in U.S. Appl. No. 15/278,704 mailed Nov. 18, 2016.
Copending U.S. Appl. No. 15/455,926, filed Mar. 10, 2017.
Notice of Allowance issued in U.S. Appl. No. 15/278,704 mailed Mar. 13, 2017.

* cited by examiner

DRUM BEATER AND DRUM FOOT PEDAL APPARATUS

BACKGROUND

The present invention relates to drum beaters for use in a drum performance, and drum foot pedal apparatus which generate a tone by pivoting such a drum beater, in response to depression of a foot board, to thereby strike a drum head or bass drum pad (kick pad) with the drum beater.

Drum foot pedal apparatus have been known which generate a tone by pivoting a beater, in response to depression of a foot board, to thereby strike a drum head with the head of the drum beater. The conventionally-known drum foot pedal apparatus, as shown for example in Japanese Patent No. 2806301 (hereinafter referred to as "Patent Literature 1"), include a pivot shaft having the beater mounted thereon, a pair of left and right struts pivotably supporting the pivot shaft, and a transmission member, such as a chain, interconnecting the distal end of the foot board and the pivot shaft. According to the disclosure of Patent Literature 1, a spring (extension or tension coil spring) for normally urging or biasing the foot board toward an initial (non-depressed) position of the foot board (and hence for, once a human player removes depressing force, causing the depressed foot board to return to the initial position by resilient returning force imparted thereby) is connected to either or both of the opposite ends of the pivot shaft. The spring is engaged at its upper end by a roller, via a link member, that is in turn rotatably supported on a crank arm, and also the spring is engaged at its lower end in a through-hole of an adjusting screw provided for adjusting the tension of the spring.

With the aforementioned conventionally-known foot pedal apparatus, it is necessary to adjust the weight of the beater (i.e., beater head and beater rod), in order to adjust a feel with which the beater head strikes the drum head (i.e., drum-striking feel), a tone generated by the beater head striking the drum head (i.e., drum-striking tone) and a depressing feel of the foot board. As one example of a beater weight adjusting mechanism for meeting such a need, a structure has been known which permits positional adjustment of a weight member attached to the beater rod, as shown in U.S. Pat. No. 7,122,730 (hereinafter referred to as "Patent Literature 2"). The structure disclosed in Patent Literature 2 is designed to adjust the attached position of the weight member on the beater rod by use of a tool. Also known is a structure in which a weight member attached to the beater is retained by screwing, as shown in U.S. Pat. No. 8,633,367 (hereinafter referred to as "Patent Literature 3"). In the structure disclosed in Patent Literature 3, a lid member is mounted to the front surface of the beater, and the weight member is attached by screwing to the front surface after removal of the lid member. The structure disclosed in Patent Literature 3 can adjust the weight of the beater by changing the number and/or type of the weight member to be attached to the beater. Also known is a structure in which a weight member is inserted into an insertion hole formed in the beater and retained in the insertion hole by attracting force of a magnet.

However, with the structure in which the weight member is attached and detached and adjusted in position using the tool, it is not possible to perform the weight adjustment of the beater without the tool. Therefore, particularly before or during a performance, ease of performing the beater weight adjustment tends to be insufficient. Further, the structure in which the weight member is retained on the beater by screwing would present the problem that attaching and detaching the weight member is troublesome taking much time and labor. Furthermore, with the structure in which the weight member is retained by the magnet, there would be a limit to the types of materials that can be used to form the weight member, because the weight member must be retainable by the magnet's attracting force. Besides, with the structure in which the weight member is retained by the magnetic, a dedicated structure utilizing the magnet's attracting force has to be provided on the beater head, which would undesirably lead to structural complication and increased numbers of component parts of the beater and the drum foot pedal apparatus.

SUMMARY OF THE INVENTION

In view of the foregoing prior art problems, it is an object of the present invention to provide a drum beater and a drum foot pedal apparatus which are simple in construction with reduced numbers of component parts and yet allow weight adjustment of the beater to be performed promptly and reliably through a mere manual operation without using any tool.

In order to accomplish the above-mentioned object, the present invention provides an improved drum beater which comprises: a beater head for striking a drum; a beater rod having the beater head mounted thereon; a retention member mounted on the beater rod in such a manner that the retention member is displaceable in an axial direction thereof relative to the beater rod, the retention member having an operating section operable with a hand of a human operator; and a weight member attached to the beater rod by being held sandwiched between the retention member and the beater head.

According to the present invention, the drum beater includes the retention member mounted on the beater rod in such a manner as to be axially movable or displaceable through a mere manual operation without using any tool, and the weight member is held sandwiched between the retention member and the beater head. Thus, weight adjustment of the drum beater can be performed through a mere manual operation without using any tool. In this way, the weight adjustment of the drum beater can be performed easily and promptly not only before but also during a performance of the drum.

Further, because the weight member is held between the retention member and the beater head, there is not a significant limit to the types of materials that can be used to form the weight member. Thus, a degree of freedom for selecting a type of material of the weight member can be enhanced, which can significantly contribute to simplification of steps for processing the weight member and cost reduction of the weight member. Besides, because the weight member is not attached directly to the beater head itself in the drum beater of the present invention, the beater head need not be limited to a particular shape and construction, and thus, a degree of freedom for selecting a shape and construction of the beater head can be enhanced.

In one embodiment of the invention, the drum beater further comprises a biasing member that normally biases the retention member toward the beater head, and the weight member is resiliently held sandwiched between the retention member and the beater head by biasing force of the biasing member. Because the weight member is resiliently held sandwiched between the retention member and the beater head by the biasing force of the spring, the construction for holding the weight member can be significantly simplified.

Moreover, because the weight member is attachable and detachable to and from the beater rod by merely moving or displacing the retention member against the biasing force of the spring, the present invention can perform the weight adjusting operation of the drum beater easily and promptly.

Further, in the drum beater of the invention, the retention member may have a projecting portion that projects toward the beater head from a part of the upper surface of the retention member opposed to the beater head, and the weight member sandwiched between the beater head and the retention member may be is retained in place by being surrounded and abuttingly contacted by the projecting portion. With the weight member surrounded and abuttingly contacted by the projecting portion like this, it is possible to not only effectively prevent positional displacement and drop-out of the weight member held between the beater head and the retention member but also facilitate operation for attaching the weight member.

Further, in one embodiment of the drum beater, the weight member has a radial recess, and the weight member is disposed around the beater rod with the beater rod inserted in the radial recess. With this arrangement, the weight member can be disposed around the beater rod, avoiding the beater rod, with the weight of the weight member distributed uniformly relative to the center axis of the beater rod. Furthermore, the operation for attaching the weight member to the beater rod can be performed easily because the weight member is attachable by the beater rod being inserted in the radial recess of the weight member.

According to another aspect of the present invention, there is provided an improved drum foot pedal apparatus which comprises: the aforementioned drum beater; a pivot shaft having the beater rod of the drum beater mounted thereon; a strut member pivotably supporting the pivot shaft; a foot board depressable with a foot of a human player; a connection member interconnecting the pivot shaft and the foot board; an arm section provided on one end portion of the pivot shaft; and a foot-board biasing member provided between the arm section and a mounting section of the strut member for normally biasing the foot board toward an initial non-depressed position of the foot-board biasing member.

Because the drum foot pedal apparatus of the present invention is provided with the drum beater constructed in the aforementioned manner, the weight adjustment of the drum beater can be performed through a mere manual operation without using any tool. In this way, the weight adjustment of the drum beater can be performed easily and promptly not only before but also during a performance of the drum. Further, because the weight member is held between the retention member and the beater head, there is not a significant limit to the types of materials that can be used to form the weight member. Thus, a degree of freedom for selecting a type of material of the weight member can be enhanced, which can significantly contribute to simplification of the steps for processing the weight member and cost reduction of the weight member. In addition, because the weight member is not attached directly to the beater head itself in the foot pedal apparatus of the present invention, the beater head need not be limited to a particular shape and construction, which can enhance a degree of freedom for selecting a shape and construction of the beater head.

As apparent from the foregoing, the drum beater and the drum foot pedal apparatus of the present invention are simple in construction with reduced numbers of component parts and yet allow the weight adjustment of the beater to be performed easily, promptly and reliably through a mere manual operation without using any tool.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

First Embodiment

Figure 1:
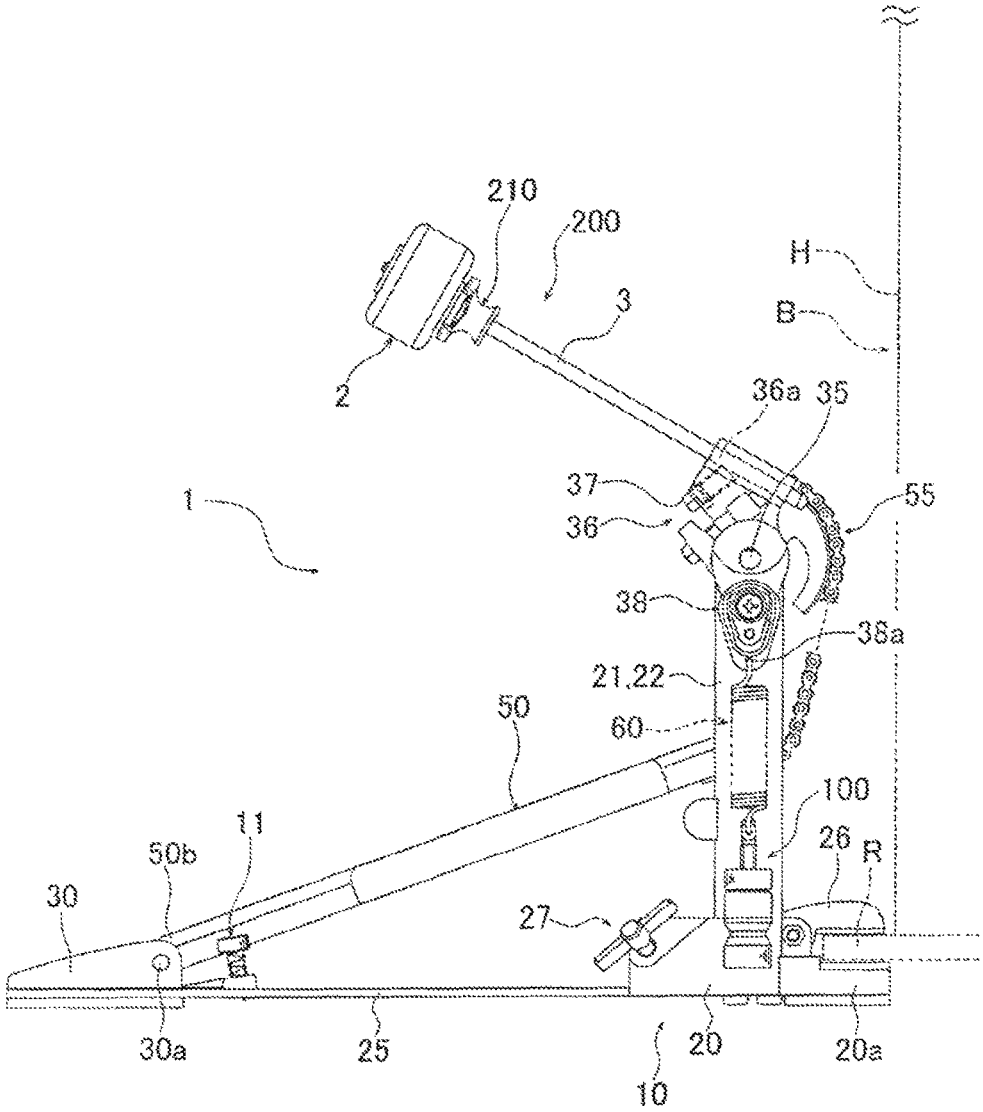
FIG. 1 is a side view showing an overall construction of a drum foot pedal apparatus employing a drum beater according to a first embodiment of the present invention.
Figure 2:
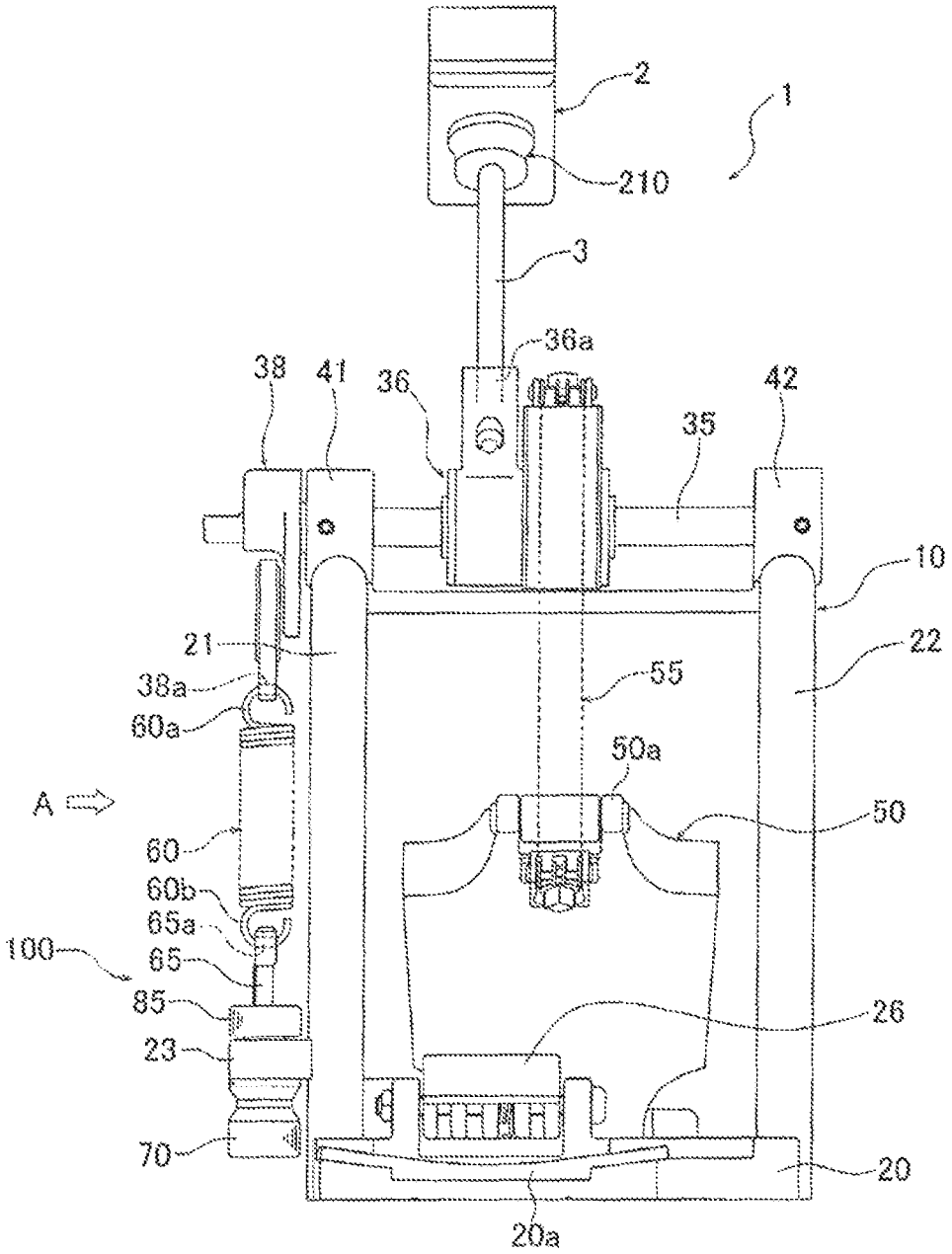
FIG. 2 is a front view of the drum foot pedal apparatus shown in FIG. 1.

FIG. 1 is a side view showing an overall construction of a drum foot pedal apparatus employing a drum beater according to a first embodiment of the present invention, and FIG. 2 is a front view of the drum foot pedal apparatus shown in FIG. 1. The foot pedal apparatus 1 shown in FIGS. 1 and 2 includes a frame 10 placed on a floor surface (installing surface) of an installation site. The frame 10 includes a base section 20, a pair of left and right strut members 21 and 22 provided on and projecting upward from the upper surface of the base section 20, and a heel member 30 connected to a rear portion of the base section 20 via a base member 25. A clamp 26 vertically sandwiching a hoop R of a bass drum B is mounted to the front end of the base section 20, and a hoop fixing screw 27 is provided for pressing the clamp 26 against the hoop R. By the hoop fixing screw 27 being tightened, the clamp 26 sandwiches the hoop R of the bass drum B in conjunction with a front end portion 20*a* of the base section 20 to thereby fix the foot pedal apparatus 1 to the bass drum B.

A pivot shaft 35 has its opposite end portions inserted in respective upper end portions of the left and right strut members 21 and 22 in such a manner that it is pivotably supported by the left and right strut members 21 and 22.

More specifically, the opposite end portions of the pivot shaft 35 are pivotably supported by bearings 41 and 42 incorporated in the upper end portions of the left and right strut members 21 and 22. A rocker 36 is mounted on an axially middle portion of the pivot shaft 35. A beater head 2 of the drum beater 200 for striking a drum head H of the bass drum B is mounted to the rocker 36 via a beater rod 3, and a connection member 55 for transmitting depressing force of the foot board 50 to the beater head 2 is fixed at its upper end portion to the rocker 36. The beater rod 3 has a base or proximal end portion slidably fittingly inserted in a through-hole 36*a* formed in the rocker 36 and fixed in the through-hole 36*a* by means of a bolt 37. It is possible to change a position, in a height direction, of the drum head H at which the beater head 2 strikes the drum head H (i.e., beater-head striking height position of the drum head H), by loosening the bolt 37 and adjusting a length of a portion of the beater rod 3 projecting from the rocker 36. Although a metal chain is used as the connection member 55 in the illustrated example, a band formed of leather or synthetic resin or the like may be used as the connection member 55.

The foot board 50 is formed of a flat plate having a size large enough for a human player to place thereon his or her foot, and the foot board 50 is connected at its front end portion 50*a* to a lower end portion of the connection member 55 and connected at its rear end portion 50*b* to the heel member 30 in such a manner that it is pivotable vertically in an up-down direction about a pivot shaft 30*a*.

Further, the foot board 50 is normally urged or biased by a coil spring (foot-board biasing member) 60 in a counter-clockwise direction in FIG. 1. The coil spring 60, which is disposed along an outer side surface of one of the strut members 21, has an upper hook 60*a* mounted to an arm member or section 38 provided on one end portion of the pivot shaft 35, and a lower hook 60*b* connected via a tension adjustment mechanism 100 to a mounting section 23 projecting from a near-lower-end portion of the strut member 21. Namely, the foot-board biasing member 60 provided between the arm section 38 and the mounting section 23 normally biases the foot board 50 toward the initial non-depressed position of the foot-board biasing member 60.

The tension adjustment mechanism 100 includes: a tension adjusting screw 65 mounted to the lower end of the coil spring 60; an adjusting nut 70 for moving the adjusting screw 65 in the up-down direction by rotation of the adjusting nut 70; and a locking nut 85 for preventing loosening of the adjusting nut 70. The adjusting screw 65 has an insertion hole 65*a* formed in an upper end portion of the adjusting screw 65, and the lower hook 60*b* of the coil spring 60 is engaged in the insertion hole 65*a*. The adjusting nut 70 is held in threaded engagement with a lower end portion of the adjusting screw 65.

Rotating the adjusting nut 70 in a tightening direction can move the adjusting screw 65 downward relative to the mounting section 23, while rotating the adjusting nut 70 in a loosening direction can move the adjusting screw 65 upward relative to the mounting section 23. Thus, the biasing force of the coil spring 60 acting on the foot board 50 can be adjusted by rotating the adjusting nut 70 to adjust a height position (relative to the mounting section 23) of the adjusting screw 65. Once desired adjustment is completed, the locking nut 85 is tightened to positionally fix the adjusting screw 65 and the adjusting nut 70.

The foot pedal apparatus 1 also includes spike members provided on a rear end portion of the base member 25; more specifically, the spike members 11 are provided one on each of widthwise opposite sides of the rear end portion of the base member 25, and are capable of being projected downward beyond the lower surface of the base member 25. The provision of such spike members 11 can prevent unwanted positional displacement of the foot pedal apparatus 1 relative to the floor surface of the installation site.

As the human player depresses the foot board 50 with his or her foot, the connection member 55 is pulled downward to cause the rocker 36 to pivot, in a clockwise direction in FIG. 1, together with the pivot shaft 35, so that the beater head 2 strikes the drum head H of the bass drum B. As the human player removes the depressing force from the foot bard 50 after the beater head 2 has struck the drum head H of the bass drum B, the pivot shaft 35 pivots in a direction, opposite the direction it pivoted at the time of the drum striking, by the tensile force of the coil spring 60, and thus, the beater head 2 and the foot board 50 return to their respective initial positions to thereby permit a next striking operation.

Figure 3:
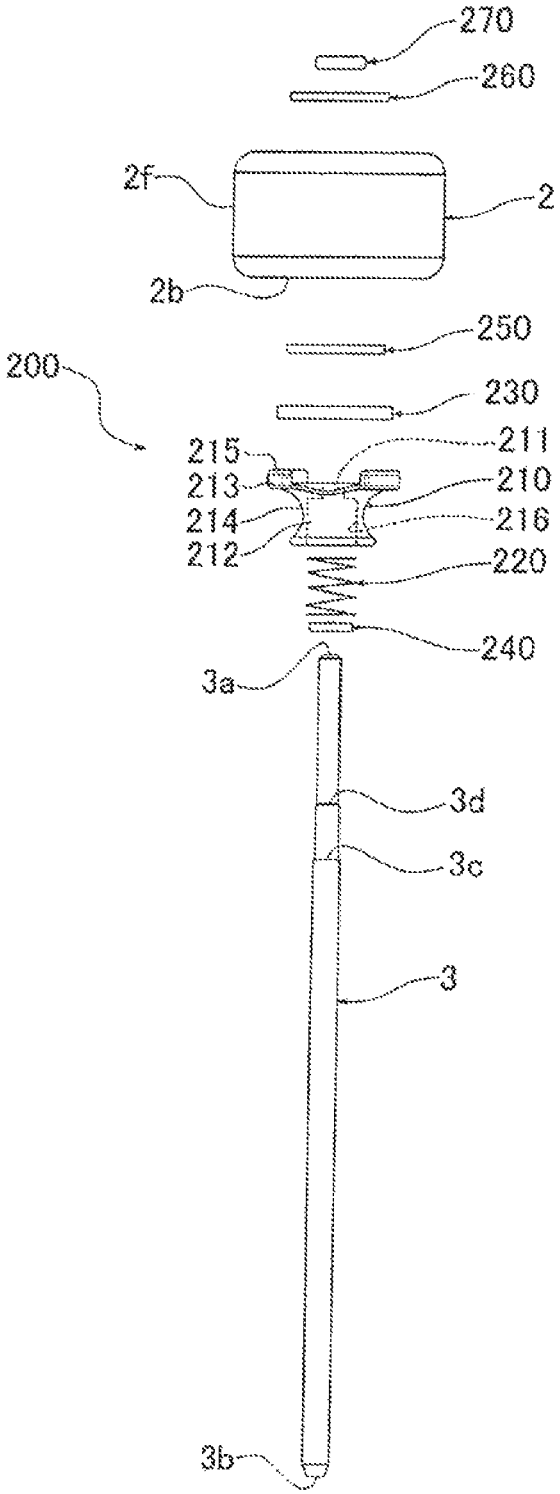
FIG. 3 is an exploded side view showing component parts of the drum beater according to the first embodiment of the present invention.
Figure 4:
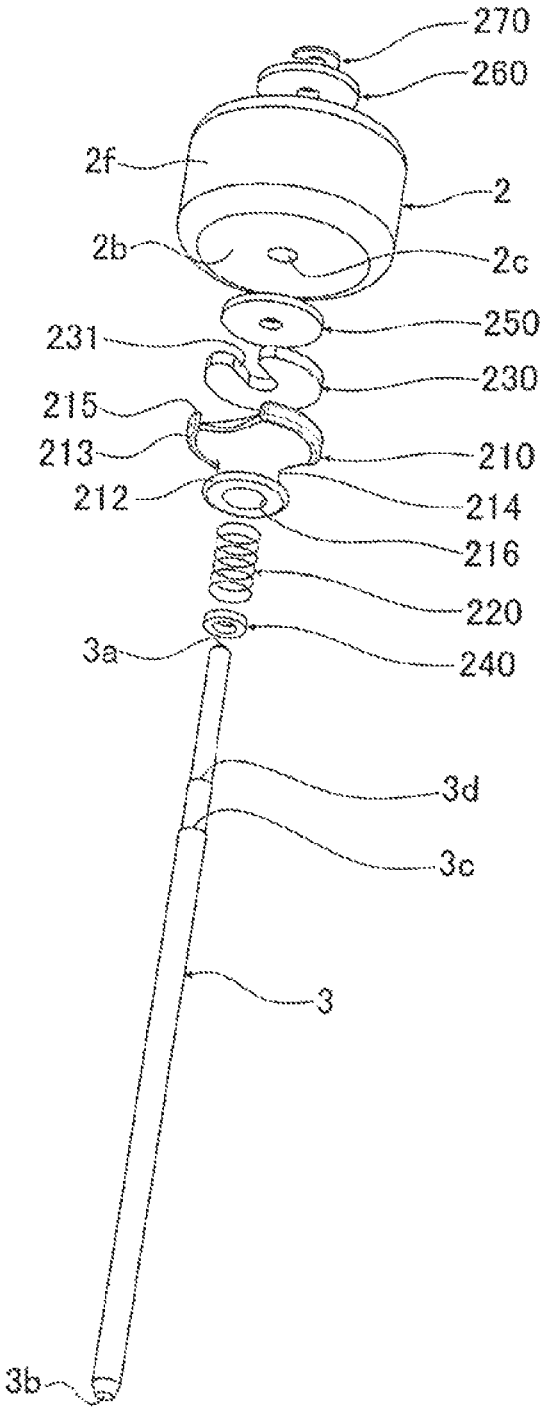
FIG. 4 is an exploded perspective view showing the component parts of the drum beater.
Figure 5:
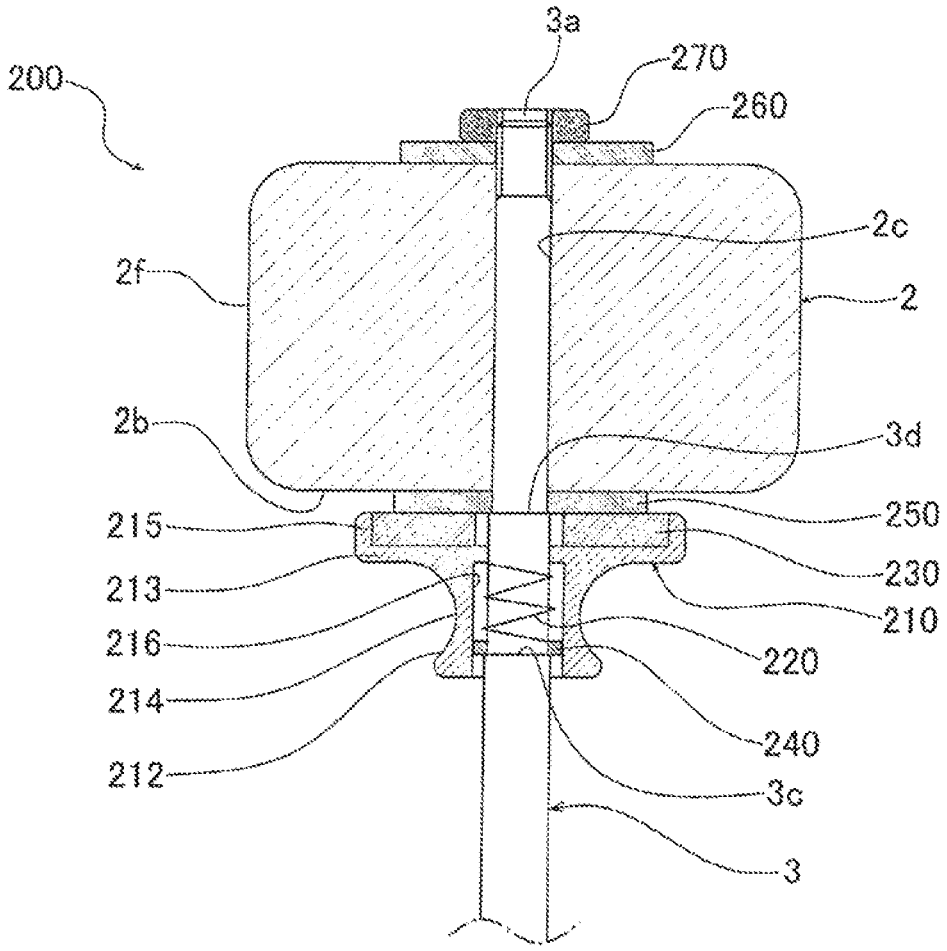
FIG. 5 is a fragmentary enlarged side view, partly in section, of a beater head and other component parts around the beater head.

FIG. 3 is an exploded side view showing component parts of the first embodiment of the drum beater 200 provided in the drum foot pedal apparatus, and FIG. 4 is an exploded perspective view showing the component parts of the drum beater 200. Further, FIG. 5 is a fragmentary enlarged side view, partly in section, of the beater head 2 and other component parts disposed around the beater head 2. As shown in these figures, the drum beater 200 includes: the beater head 2 for striking the drum head H; the beater rod 3 supporting the beater head 2; a retention member 210 mounted on the beater rod 3; a spring (biasing member) 220 normally biasing or urging the retention member 210 toward the beater head 2; and a weight member 230 held or retained sandwiched between the retention member 210 and the beater head 2 by the biasing force of the spring 220. Note that the terms "upper", "lower" etc. used in the following description refer to "upper", "lower" etc. in the orientation of the drum beater 200 shown in FIG. 3.

The beater rod 3, which is a rod member of a circular cross-section shape, has first and second stepped portions 3*c* and 3*d* that are formed on its two longitudinally intermediate portions in spaced apart relation from each other and that differ from each other in diameter; the first or lower stepped portion 3*c* has a greater diameter than the second or upper stepped portion 3*d*. The above-mentioned spring 220 is abutted at its one end (lower end) against a washer 240 of a circular ring shape that is in turn engaged by the first or lower stepped portion 3*c* of the beater rod 3, and the spring 220 is abutted at the other end (upper end) against the retention member 210.

The retention member 210, which is a member having an axial through-hole 211 formed centrally therethrough such that the beater rod 3 is passed through the through-hole 211, has a base section 212 of a substantially cylindrical shape formed in a lower region of the retention member 210, and a retaining section 213 of a thin plate shape formed above and integrally with the base section 212. The base section 212 has, on its outer peripheral surface, an operating section 214 formed as a circumferential waist-like narrowed section, and this operating section 214 is operable by a user or human operator pinching or holding the same with his or her hand (fingers) when the retention member 210 is to be moved. The retaining section 213 has a substantially disk shape greater in diameter than the base section 212, and a generally-cylindrical outer peripheral edge portion 215 is formed on and along the outer peripheral edge thereof and projecting upward toward the beater head 2. A recess is formed in a part of the outer peripheral edge portion 215. Namely, the retaining section 213 defines the upper surface of the retention member 210 opposed to the beater head 2, and the outer peripheral edge portion 215 defines a projecting portion that projects upward from a part (i.e., outer peripheral edge region) of the upper surface of the retention member 210.

The weight member 230 is a member of a substantially circular, thin plate shape which has such a contour as to extend along the outer peripheral edge of the retaining section 213. The weight member 230 has a radial recess 231 of a substantially U shape extending radially from a part of its outer peripheral edge thereof toward its center. The weight member 230 may be formed of any desired appropriate material, like metal or synthetic resin, such that it has a desired mass. As an example, the weight member 230 may be formed of brass.

The beater head 2, which has a substantially cylindrical contour, has an axial through-hole 2*c* through which the beater rod 3 extends. The beater head 2 is formed of fabric, such as felt, synthetic resin, or the like, and the outer peripheral side surface 2*f* of the beater head 2 is constructed as a striking surface 2*f* for striking the drum head H. Immediately beneath the beater head 2 is disposed a washer of a circular ring shape 250 that is engaged on the second or upper stepped portion 3*d*. Further, immediately above the beater head 2 is disposed a washer 260 that is engaged on the distal end (upper end) 3*a* of the beater head 3, for example, by means of a circlip (retaining ring) 270.

To assemble the drum beater 200 including the aforementioned component parts, the washer 240, the spring 220 and the retention member 210 are assembled, from above the upper end 3*a*, to the beater rod 3 in the order mentioned here. The washer 240 is engaged on the first stepped portion 3*c* of the beater rod 3, and the retention member 210 is placed on the washer 240 with the spring 220 disposed therebetween and accommodated in an inner accommodating region 216 of the retention member 210 as shown in FIG. 5. Further, the washer 250, the beater head 2 and the washer 260 are assembled to portions of the beater rod 3 above the retention member 210 in the order mentioned here, and the circlip 270 is mounted on the beater rod's upper end portion 3*a* projecting upward beyond the washer 260 to thereby engage the washer 260. Thus, the beater head 2 is supported between the washer 250 engaged on the second or upper washer 3*d* and the washer 260 engaged by the circlip 270. Further, the retention member 210 biased upward by the spring 220 is held in resilient abutment against the lower surface 2*b* (washer 250) of the beater head 2. Note that, in this state, the weight member 230 is not yet attached to the beater rod 3.

Figure 6A:
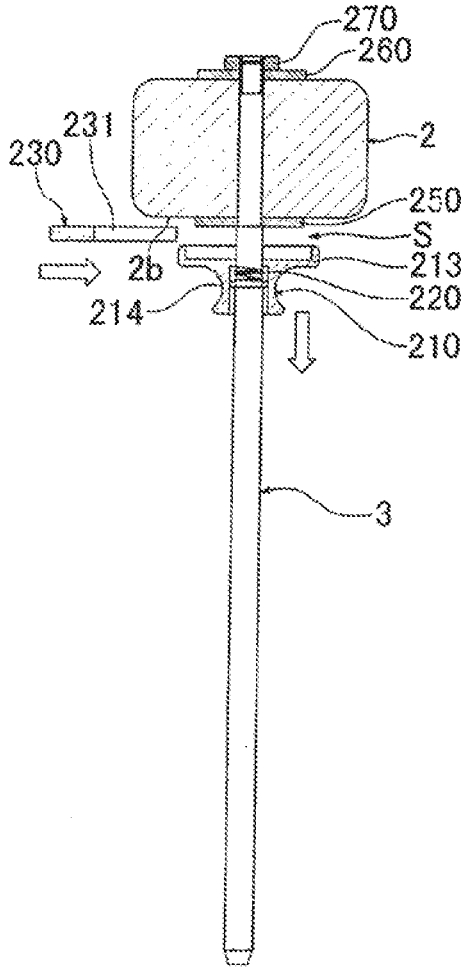
FIGS. 6A and 6B are views explanatory of an operational sequence for attaching a weight member to the beater rod.
Figure 6B:
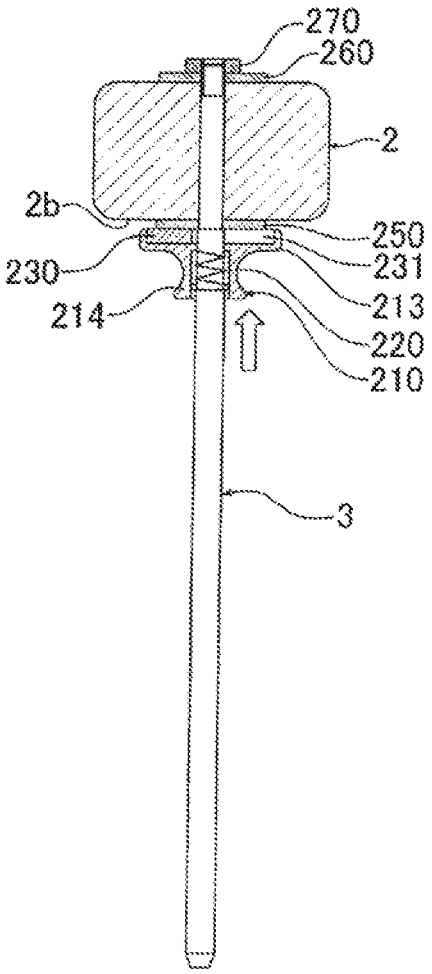

FIGS. 6A and 6B are views explanatory of an example operational sequence for attaching the weight member 230 to the beater rod 3. For attaching the weight member 230 to the beater rod 3, the retention member 210 is pulled axially downward by the human operator holding the operating section 214 with his or her hand (fingers), as shown in FIG. 6A. Thus, the retention member 210 moves downward against the biasing force of the spring 220, so that a gap S is formed between the retaining section 213 of the retention member 210 and the lower surface 2*b* of the beater head 2 (washer 250). In this state, the weight member 230 is attached to the beater rod 3 by being inserted into the space S. More specifically, the weight member 230 is attached to the beater rod 3 by the beater rod 3 being inserted sideways into the radial recess 231 of the weight member 230. Then, as the force pulling (depressing) the retention member 210 axially downward is removed, the retention member 210 moves upward by the biasing force of the spring 220, so that the weight member 230 is resiliently retained or held sandwiched between the beater head 2 and the retention member 210. More specifically, the weight member 230 is resiliently sandwiched between the retaining section 213 of the retention member 210 and the lower surface 2*b* of the beater head 2 (washer 250). Further, the weight member 230 is prevented from accidentally slipping or dropping out of the space S because the outer peripheral edge of the weight member 230 is surrounded and abuttingly contacted by the outer peripheral edge portion (projecting portion) 215 of the retaining section 213. Namely, the weight member 230 is resiliently sandwiched between the beater head 2 (washer 250) and a portion of the upper surface of the retention member 210 other than the outer peripheral edge portion 215 (more specifically, a portion of the retention member 210 located radially inward of the outer peripheral edge portion 215), so that radial movement or displacement of the weight member 230 is prevented by the outer peripheral edge portion 215.

Further, to detach the weight member 230 from the beater rod 3, the retention member 210 is pulled axially downward by the human operator holding the operating section 214 with his or her hand (fingers), and then the weight member 230 is pulled out of the space S between the retaining section 213 and the lower surface 2*b* of the beater head 2.

As described above, the first embodiment of the drum beater 200 includes the retention member 210 mounted on the beater rod 3 in such a manner as to be axially movable or displaceable through a mere manual operation, and the weight member 230 is resiliently held sandwiched between the retention member 210 and the beater head 2. Thus, the weight adjustment of the drum beater 200 can be performed through a mere manual operation without using any tool. In this way, the weight adjustment of the drum beater 200 can be performed easily and promptly not only before but also during a performance of the drum.

Further, because the weight member 230 is resiliently held sandwiched between the retention member 210 and the beater head 2, there is not a significant limit to the types of materials that can be used to form the weight member 230 (i.e., the material forming the weight member 230 can be selected from among a wide variety of materials without being limited to particular types of materials), and the shape of the weight member 230 too can be set relatively freely. Thus, a degree of freedom for selecting a type of material and shape of the weight member 230 can be enhanced, which can significantly contribute to simplification of steps for processing the weight member 230 and cost reduction of the weight member 230.

Furthermore, because the weight member 230 is not attached directly to the beater head 2 itself, the beater head 2 need not be limited in its shape and construction. Thus, it is also possible to enhance a degree of freedom for selecting a shape and construction of the beater head 2; that is, the beater head 2 can be formed in various shapes and constructions.

Furthermore, as noted above, the drum beater 200 includes the spring 220 normally biasing the retention member 210 toward the beater head 2, and the weight member 230 is resiliently held sandwiched between the retention member 210 and the beater head 2 by the biasing force of the spring 220. In this way, the construction for holding the weight member 230 can be significantly simplified. Moreover, because the weight member 230 is attachable and detachable by merely axially moving or displacing the retention member 210 against the biasing force of the spring 220, the weight adjusting operation of the drum beater 200 can be performed easily and promptly.

Further, the drum beater 200 has the outer peripheral edge portion (projecting portion) 215 formed on the outer periphery of the retention member 210 (retaining section 213) and projecting toward the beater head 2, and the weight member 230 sandwiched between the beater head 2 and the retention member 210 is retained in place by being surrounded and contacted by the outer peripheral edge portion 215. With the weight member 230 surrounded and contacted by the outer peripheral edge portion 215 like this, it is possible to not only effectively prevent positional displacement and drop-out, from the beater rod 3, of the weight member 230 retained between the beater head 2 and the retention member 210 but also facilitate the attaching operation of the weight member 230.

Furthermore, the drum beater 200 has the radial recess 231 formed in the weight member 230, and the weight member 230 is disposed around the outer periphery of the beater rod 3 with the beater rod 3 inserted in the radial recess 231, and thus, the weight member 230 can be disposed around the beater head 3, avoiding the beater rod 3, with the weight of the weight member 230 uniformly distributed relative to the center axis of the beater rod. Furthermore, the attaching operation of the weight member 230 can be performed easily because the weight member 230 is attachable by the beater rod 3 being inserted in the radial recess 231 of the weight member 230.

Second Embodiment

Next, a second embodiment of the present invention will be described. Note that, in the following description of the second and third embodiments and corresponding figures in the drawings, the same or like elements as in the first embodiment are represented by the same reference numerals as in the first embodiment and will not be described here to avoid unnecessary duplication. Also note that other elements and features than those to be described below are the same as in the first embodiment.

Figure 7:
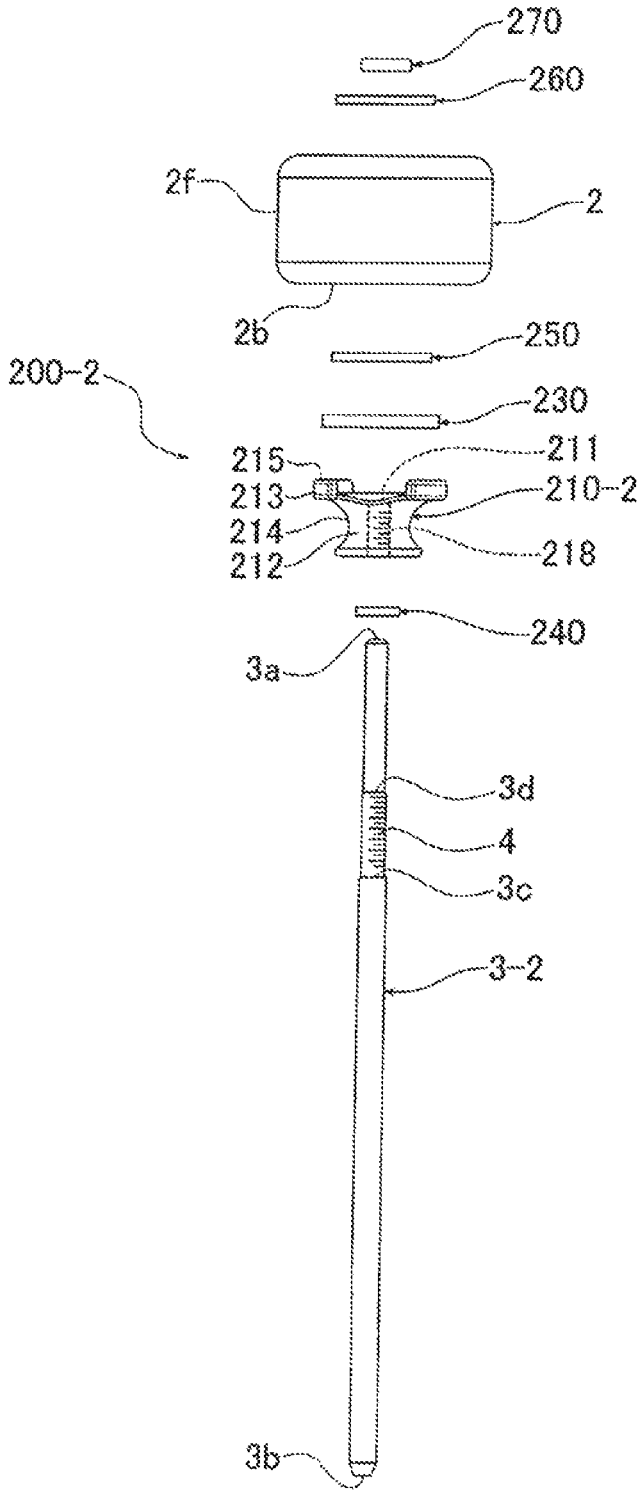
FIG. 7 is an exploded side view of a drum beater according to a second embodiment of the present invention.

FIG. 7 is an exploded side view of a drum beater 200-2 according to the second embodiment of the present invention. Whereas the retention member 210 of the drum beater 200 according to the first embodiment is normally biased by the biasing force of the spring 220 and axially movable relative to the beater rod 3 against or by the biasing force of the spring 220, the retention member 210-2 of the drum beater 200-2 according to the second embodiment is constructed to be axially movable relative to the beater rod 3 through rotation of a screw structure.

Namely, the drum beater 200-2 according to the second embodiment is characterized in that the spring 220 of the retention member 210-2 according to the first embodiment is omitted (dispensed with), and in that a retention member 210-2 and a beater rod 3-2 different in construction from the retention member 210 and the beater rod 3 in the first embodiment are provided. The retention member 210-2 has a female (internal) thread formed in the inner peripheral surface of the axial through-hole 211 of the retention member 210-2, and the beater rod 3-2 has a male (external) thread 4 formed on the outer peripheral surface between the first stepped portion 3*c* and the second stepped portion 3*d*. Thus, the beater rod 3-2 can be inserted and mounted to the through-hole 211 of the retention member 210-2 by the female thread 218 of the though-hole 211 threadedly engaging with the male thread 4 of the beater rod 3-2. Thus, the retention member 210-2 is movable or displaceable in the axial direction of the beater rod 3-2 by being rotated or turned to cause axial travel through the helical engagement between the female thread 218 and the male thread 4. Namely, the male and female threads 4 and 218 together constitute a screw structure for converting a rotational motion, applied to the operating section 214 of the retention member 210-2, into axial displacement of the retention member 210-2.

In the drum beater 200-2 according to the second embodiment too, the weight member 230 can be held sandwiched between the retention member 210-2 and the beater head 2. Thus, the weight adjustment of the drum beater 200-2 can be performed through a mere manual operation without using any tool. In this way, the weight adjustment of the drum beater 200-2 can be performed easily and promptly not only before but also during a drum performance.

Third Embodiment

Figure 8:
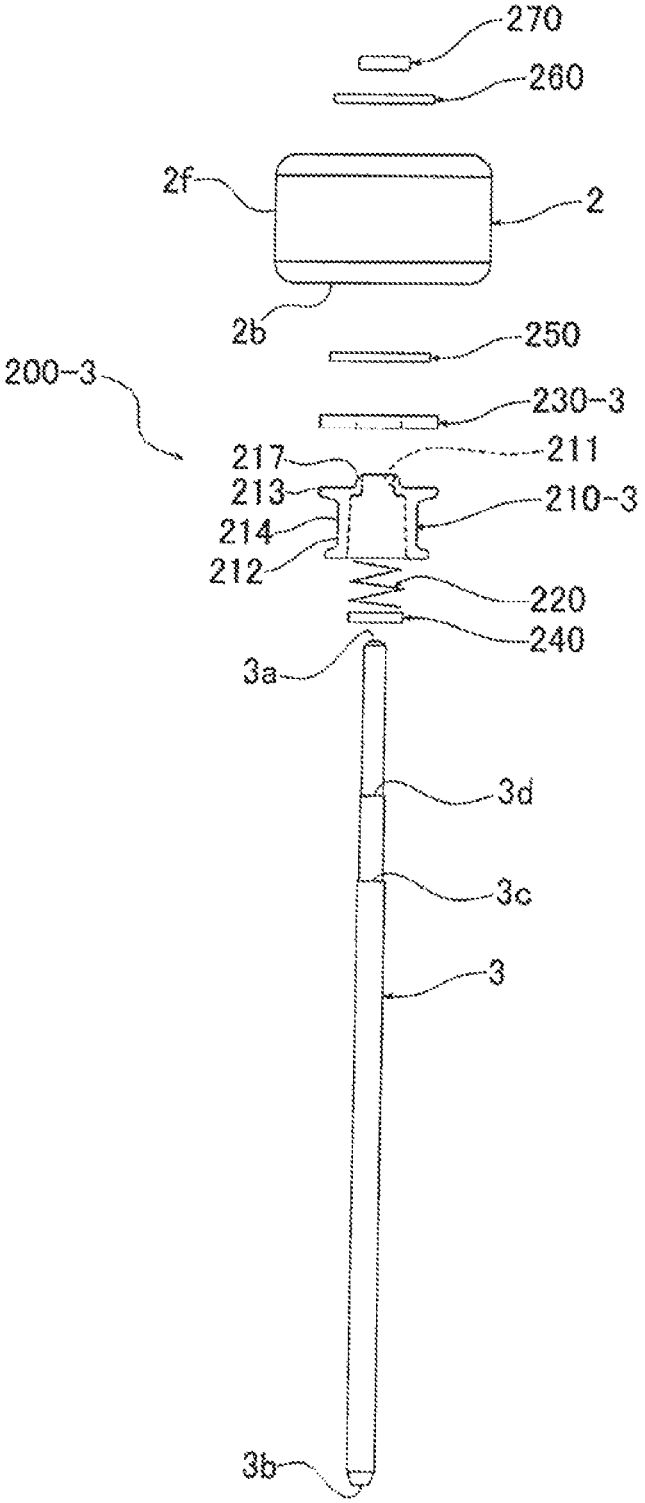
FIG. 8 is an exploded side view of a drum beater according to a third embodiment of the present invention.
Figure 9:
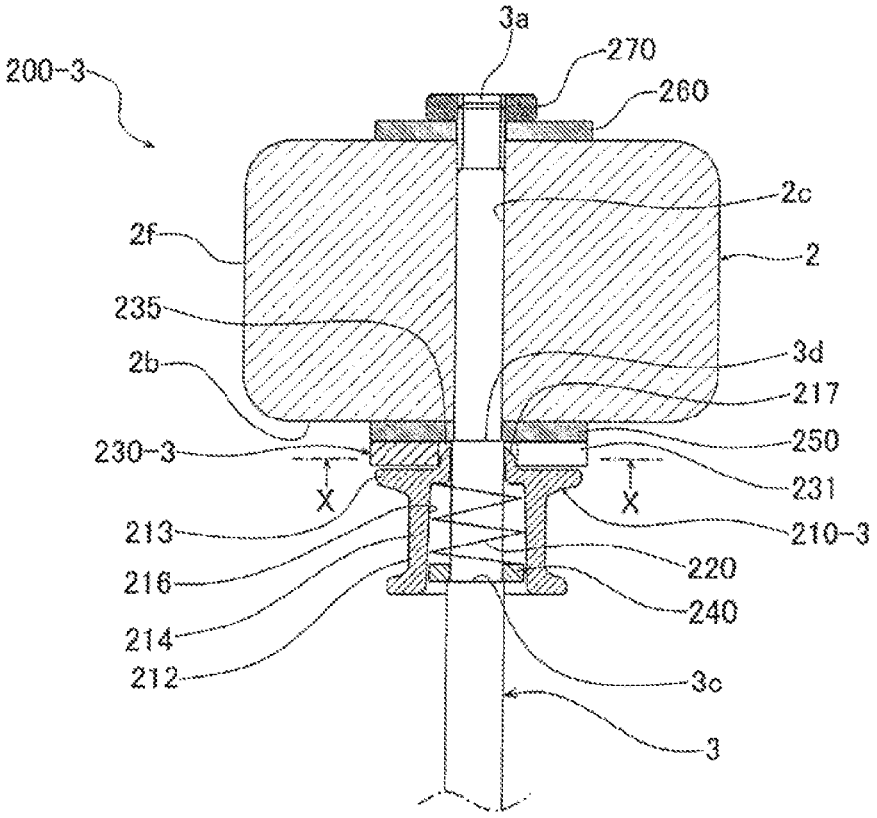
FIG. 9 is a fragmentary enlarged side view, partly in section, of a beater head of the drum beater and other component parts around the beater head in the third embodiment.
Figure 10:
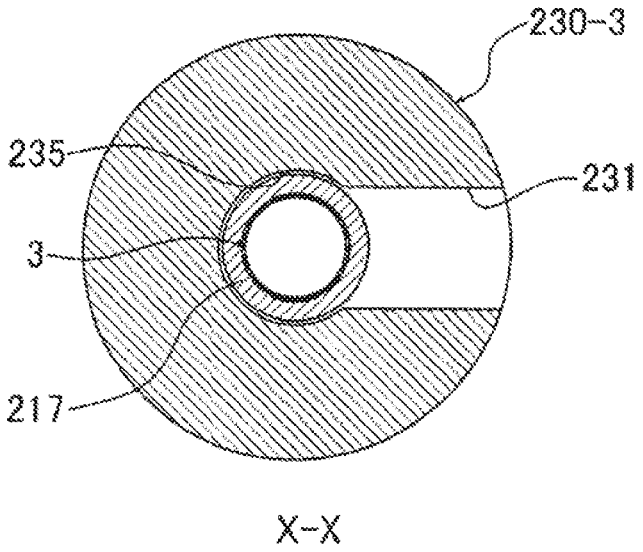
FIG. 10 is a sectional view taken along the X-X line of FIG. 9.

Next, a description will be given about a third embodiment of the present invention. FIG. 8 is an exploded side view of a drum beater 200-3 according to the third embodiment, and FIG. 9 is a fragmentary enlarged side view, partly in section, of the beater head 2 of the drum beater 200-3 according to the third embodiment and other component parts disposed around the beater head 2, and FIG. 10 is a sectional view taken along the line X-X of FIG. 9. Whereas the drum beater 200 according to the first embodiment has the outer peripheral edge portion 215 formed on the outer periphery of the retention member 210 (retaining section 213) and projecting toward the beater head 2, the retention member 210-3 in the third embodiment of the drum beater 200-3 has an inner peripheral edge portion 217 formed on the inner peripheral edge of the retention member 210-3 (retaining section 213) and projecting toward the beater head 2. Namely, the retaining section 213 in the third embodiment defines the upper surface of the retention member 210-3 opposed to the beater head 2, and the inner peripheral edge portion 217 constitutes a projecting portion that projects upward from a part (i.e., inner peripheral edge region) of the upper surface of the retention member 210-3.

The inner peripheral edge portion 217 is in the form of a projection of a circular ring shape formed on a region of the upper surface of the retention member 210-3 (retaining section 213) located around the axial through-hole 211. The inner peripheral edge portion 217 has such an outer diameter as to be insertable in an axial through-hole 235 (FIG. 10) formed centrally through the weight member 230-3. The through-hole 235 is aligned in communication with the radial recess 231 and has a diameter slightly smaller than a width of the radial recess 231.

When the weight member 230-3 is resiliently held sandwiched between the beater head 2 (washer 250) and the retention member 210-3 with the retention member 210-3 biased toward the beater head 2 by the biasing force of the spring 220, the inner peripheral edge portion 217 of the retention member 210-3 is inserted into the through-hole 235. Thus, the weight member 230-3 can be prevented from being positionally displaced laterally relative to the retention member 210-3. In this way, the weight member 230-3 sandwiched between the beater head 2 (washer 250) and the retention member 210-3 can be reliably prevented from slipping or dropping out from between the beater head 2 (washer 250) and the retention member 210-3. Namely, because the weight member 230-3 is sandwiched between the beater head 2 and a portion of the upper surface of the retention member 210-3 other than the inner peripheral edge portion 217 (more specifically, a portion of the retention member 210-3 located radially outward of the inner peripheral edge portion 217), radial displacement of the weight member 230-3 can be prevented. Note that, whereas the third embodiment has been described above in relation to the case where the inner peripheral edge portion 217 is in the form of a projection of a circular ring shape, the inner peripheral edge portion 217 may have other than the circular ring shape, such as a partly-recessed shape.

It should be appreciated that the present invention is not limited to the above-described embodiments and may be modified variously within the scope of the technical idea disclosed in the claims, specification and drawings. For example, whereas the embodiments of the present invention have been described above in relation to the case where only one weight member 230 (230-3) is held sandwiched between the retention member 210 (210-2, 210-3) and the beater head 2, two or more such weight members may be held sandwiched between the retention member 210 (210-2, 210-3) and the beater head 2.

Further, whereas the embodiments of the present invention have been described above in relation to the case where the weight member 230 of the drum beater 200 is attached to the beater rod 3 adjacent to one end surface of the beater head 2 located closer to the proximal end (pivot point) of the beater rod 3, the weight member 230 may alternatively be attached to the beater rod 3 adjacent to the other end surface of the beater head 2 located closer to the distal end (free end) of the beater rod 3. Further, in the above-described first and third embodiments, the spring 220 is supported by the stepped portion 3*c* of the beater rod 3 and the washer 240. Alternatively, a thread may be formed on a free end portion of the beater rod 3 in place of the stepped portion 3*c*, and the washer 240 may be engaged in place by a bolt or the like screwed to the thread formed on the free end portion. Furthermore, even in the case where the retention member 210-2 and the weight member 230-2 of the second embodiment are applied to a distal end portion of the beater rod 3, the above-described structural arrangements may be employed as-is, or with no modification.

Furthermore, whereas the above-described embodiments are constructed to, by moving or displacing the retention member in the axial direction of the beater rod through the axial sliding movement of the retention member or through the helical thread-to-thread engagement between the retention member and the beater rod, switch the weight member between a position (attachable/detachable position) where the weight member can be attached and detached and a position (retainable position) where the weight member is retained in the attached position. Alternatively, however, a recess may be formed in a part of the outer peripheral edge portion of the retention member so that the weight member can be attached and detached through such a recess only when the retention member is in a predetermined rotational position. In such a case, the weight member can be shifted between the attachable/detachable position and the retainable position, by merely rotating the retention member about its axis at a same axial position, i.e. without being displaced in the axial direction.

Further, whereas the embodiments have been described above in relation to the case where the retention member is operated by the user or human operator pulling or rotating the same while holding the operating section with fingers or the like, the form of operation of the retention member is not so limited, and the retention member may be moved by any other suitable forms of operations.

Furthermore, whereas, according to the above disclosure, the projecting portion provided on the retention member is the outer peripheral edge portion 215 formed on and along the outer peripheral edge of the retention member so as to surround the weight member (in the case of the first embodiment) or the inner peripheral edge portion 217 formed on and along the inner peripheral edge of the retention member so as to fit in and abut against the through-hole 235 of the weight member 230 (in the case of the third embodiment), the projecting portion in the present invention is not limited to those formed on and long the outer or inner peripheral edge of the retention member. As an example alternative structure, a projection may be formed on a radially central position of the surface of the retention member abutting against the weight member and a hole or recess may be formed in the surface of the weight member abutting against the retention member so that the projection and the recess are brought into fitting engagement with each other as the surfaces of the retention member and the weight member are caused to abut against each other. In this way too, positional displacement of the weight member can be prevented effectively.

Moreover, whereas the embodiments each have been described as applied to a drum foot pedal for striking a bass drum of an acoustic drum, the basic principles of the present invention may be applied to a drum foot pedal for striking a bass drum pad of an electronic drum.

This application is based on, and claims priority to, JP PA 2015-194502 filed on 30 Sep. 2015. The disclosure of the priority application, in its entirety, including the drawings, claims, and the specification thereof, are incorporated herein by reference.

What is claimed is:

1. A drum beater comprising:

a beater head for striking a drum;

a beater rod having the beater head mounted thereon at one-end side;

a retention member mounted on the beater rod and displaceable in an axial direction of the beater rod, the retention member having an operating section configured to be operable with a hand of a human operator; and a weight member attached to the beater rod and sandwiched between the retention member and the beater head, wherein the retention member is disposed closer to an opposite-end side of the beater rod than the beater head.

2. The drum beater as claimed in claim 1, wherein the weight member is attachable and detachable to and from the beater rod by displacing the retention member in the axial direction relative to the beater rod.

3. The drum beater as claimed in claim 1, further comprising:

a biasing member that normally biases the retention member toward the beater head, wherein the weight member is resiliently held sandwiched between the retention member and the beater head by a biasing force of the biasing member.

4. The drum beater as claimed in claim 1, further comprising a screw structure that converts a rotational motion applied to the operating section of the retention member to displacement in the axial direction of the retention member.

5. The drum beater as claimed in claim 1, wherein:

the retention member has a projecting portion that projects from a part of an upper surface of the retention member toward the beater head and providing a recess, and the weight member is disposed in the recess to prevent a radial movement of the weight member.

6. The drum beater as claimed in claim 1, wherein the weight member has a radial recess formed therein and is disposed around the beater rod with the beater rod inserted in the radial recess.

7. The drum beater as claimed in claim 1, wherein the beater rod is configured to be controlled with a foot board from an opposite-end side thereof.

8. A drum foot pedal apparatus comprising:

a drum beater comprising:

a beater head for striking a drum;

a beater rod having the beater head mounted thereon at one-end side;

a retention member mounted on the beater rod and displaceable in an axial direction of the beater rod, the retention member having an operating section configured to be operable with a hand of a human operator; and a weight member attached to the beater rod and sandwiched between the retention member and the beater head, wherein the retention member is disposed closer to an opposite-side end of the beater rod that the beater head, a pivot shaft mounting the beater rod of the drum beater from the opposite-side end thereof;

a strut member pivotably supporting the pivot shaft;

a foot board;

a connection member interconnecting the pivot shaft and the foot board;

an arm section provided on one end portion of the pivot shaft; and a foot-board biasing member provided between the arm section and a mounting section of the strut member for normally biasing the foot board toward an initial non-depressed position of the foot-board biasing member.

9. A drum beater comprising:

a beater head for striking a drum;

a beater rod having the beater head mounted thereon;

a retention member mounted on the beater rod and displaceable in an axial direction of the beater rod, the retention member having an operating section configured to be operable with a hand of a human operator;

a weight member attached to the beater rod and held sandwiched between the retention member and the beater head; and a biasing member that normally biases the retention member toward the beater head, wherein the weight member is resiliently held sandwiched between the retention member and the beater head by a biasing force of the biasing member.

* * * * *